US006212779B1

(12) United States Patent
Mitchell

(10) Patent No.: US 6,212,779 B1
(45) Date of Patent: Apr. 10, 2001

(54) KNIFE WITH PIVOTALLY MOUNTED BLADE

(76) Inventor: Jeffrey T. Mitchell, 345 Philippa Pl., Lake Mary, FL (US) 32746-3448

( * ) Notice: Subject to any disclaimer, the term of this patent is extended or adjusted under 35 U.S.C. 154(b) by 0 days.

(21) Appl. No.: 09/519,431

(22) Filed: Mar. 6, 2000

(51) Int. Cl.[7] ..... B26B 1/04
(52) U.S. Cl. ..... 30/161
(58) Field of Search ..... 30/160, 161, 519, 30/331

(56) References Cited

U.S. PATENT DOCUMENTS

| | | | |
|---|---|---|---|
| 294,471 | | 3/1884 | Huff . |
| 304,451 | | 9/1884 | Rauh . |
| 357,353 | | 2/1887 | Wiesner . |
| 1,358,097 | | 11/1920 | Neft . |
| 1,428,296 | | 9/1922 | Neft . |
| 1,477,483 | | 12/1923 | Hartley . |
| 2,591,655 | | 4/1952 | Foley . |
| 3,702,501 | | 11/1972 | Wood . |
| 3,942,249 | | 3/1976 | Poehlmann . |
| 4,170,061 | * | 10/1979 | Henry ..... 30/160 |
| 4,535,539 | * | 8/1985 | Friedman et al. ..... 30/161 |
| 4,541,175 | | 9/1985 | Boyd et al. . |
| 4,551,917 | | 11/1985 | Walker . |
| 4,670,984 | | 6/1987 | Rickard . |
| 5,437,101 | | 8/1995 | Collins . |
| 5,979,065 | * | 11/1999 | Hsu ..... 30/161 X |

* cited by examiner

*Primary Examiner*—Douglas D. Watts
(74) *Attorney, Agent, or Firm*—Julian C. Renfro

(57) ABSTRACT

A knife comprising a pair of elongate handle members that, when fitted together, form a mounting means for pivotal movements of a sharpened blade. The blade has a terminus at one end and a circular aperture adjacent the other end. The blade is movable between extended and folded positions, with the handle members forming a means for grasping the knife when the blade is in its extended position as well as safely enclosing the blade when the knife is not in use and the blade has been moved to its folded position. A protrusion is located mounted on the internal surface adjacent one end of each handle member, with each of the protrusions being disposed on only one side of a longitudinal centerline extending along the internal surface of each handle member. The part of each protrusion remote from the centerline has an essentially semi-circular surface, with the protrusions being caused, when the handle members have been interfitted, to reside closely together to define a substantially circular component. The aperture of the blade is of a diameter to be closely received upon the protrusions when the protrusions have been disposed closely together. The handle members are movable apart for a limited extent while causing a limited amount of sliding movement of one of the protrusions relative to the other, with such movement apart creating sufficient space between the handle members as to permit the pivotal movement of the blade into either its folded or its extended position.

14 Claims, 3 Drawing Sheets

KNIFE WITH PIVOTALLY MOUNTED BLADE

BACKGROUND OF THE INVENTION

Folding knives are well known in the art and serve a variety of uses, with the primary purpose of the folding feature being to conceal the sharpened edge of the blade so that the knife may be safely carried without an additional cover or sheath. An additional purpose is to reduce the overall length of the knife for more convenient carrying.

Numerous designs of folding knives have been developed in the past, both of the locking and non-locking variety. The primary benefits of the simple, non-locking foldable knife are its simplicity and economy, since there is usually only one principal moving part, the blade. However, any inability to lock the blade in its extended position places serious limitations on the use of such a knife for purposes such as self defense and other demanding activities.

Locking foldable or retractable knives have taken many forms, including blades which slide out of the handle and lock, and pivoting blades which are released and locked by one or more mechanisms operated by the user. While such knives have broad utility and are available in many forms, they usually suffer from one or more of the following deficiencies: inability to accommodate a blade with more than one sharpened edge; inability to be opened or closed with either hand; awkward or unreliable operation of the blade locking mechanism; inability to be quickly and easily disassembled for maintenance or repair; and susceptibility to contaminants which could render the knife inoperable. Therefore, despite the long and continued development of folding knives capable of being positively locked in the open position, there still exists the need for a knife of economical construction which can satisfactorily overcome the aforementioned deficiencies of contemporary folding knives.

SUMMARY OF THE INVENTION

In accordance with this invention I have provided a novel folding knife having a pivotally mounted blade, with this knife utilizing two elongate handle members. When fitted together, these handle members form a mounting means for pivotal movement of the blade and safely enclose the blade when the knife is not in use and in addition, provide a means for grasping the knife when the blade is in the extended position.

Each of the elongate handle members provided in accordance with this invention has an internal surface and an external surface, with a protrusion located on the internal surface of each elongate handle member, adjacent one end of the handle member. The protrusion is disposed on only one side of a longitudinal centerline extending along the internal surface of each elongate handle member, with the part of the protrusion remote from the longitudinal centerline having an essentially semi-circular surface. An aperture is defined in each elongate handle member, disposed on the longitudinal centerline and located closely adjacent the protrusion.

When the elongate handle members have been fitted together, the protrusions define a substantially circular component, suitable for the mounting of a pivotally movable blade.

The blade is elongate with the sharpened edges originating at one end and a circular aperture adjacent the other end, with the aperture of the blade being of a diameter such that it can be closely received upon the protrusions when the protrusions have been juxtaposed so as to form the substantially circular component.

Significantly, the elongate handle members may be moved apart for a limited extent by the user, so as to make possible the pivotal movement of the blade into its extended position. When in such extended position, it will be strongly held and restrained against undesirable movement.

Instead of necessitating an expensive or complicated spring mechanism for causing the elongate handle members to be biased together when the blade is either in the folded or the extended position, my novel design permits the highly advantageous use of a compression spring of straightforward construction, thus assuring that my knife can be produced economically, and the spring easily replaced should such ever become necessary. An actuating disk is disposed in each handle member, with the simultaneous depression of the actuating disks bringing about the compression spring being compressed.

It will hereinafter be seen that I utilize two pairs of alignment pins of essentially cylindrical configuration and through contact with the respective actuating disk, each pair of alignment pins is pushed into contact with the base portion of the blade, so that when the actuating disks have been fully depressed, the alignment pins positively locate the blade in a centered position between the elongate handle members, which permits the blade to freely rotate from the folded position into the extended position, or from the extended position into the folded position.

Additionally, my novel design of the handle members is such that a multi-edged blade, rather than merely a single edged blade, can be accommodated.

It is therefore a primary object of my invention to provide a folding knife of economical construction that advantageously may be safely and conveniently opened or closed by one handed operation.

It is another object of my invention to provide a folding knife having handle members biased together by spring means to safely enclose the blade, with these handle members being movable apart for a limited extent when it is desired to deploy the blade, with the handle members then reclosing under the bias of the spring means to firmly and securely hold the blade in the extended position when the blade is to be put into use.

It is still another object of my invention to provide a folding knife involving a minimal number of components, with a pair of alignment pins utilized on each side of the blade to serve a blade centering purpose, thus to cause the blade to reside essentially equidistant from the handle members when the handle members have been moved apart.

These and other objects, features and advantages will become more apparent as the description proceeds.

DETAILED DESCRIPTION

Figure 1:
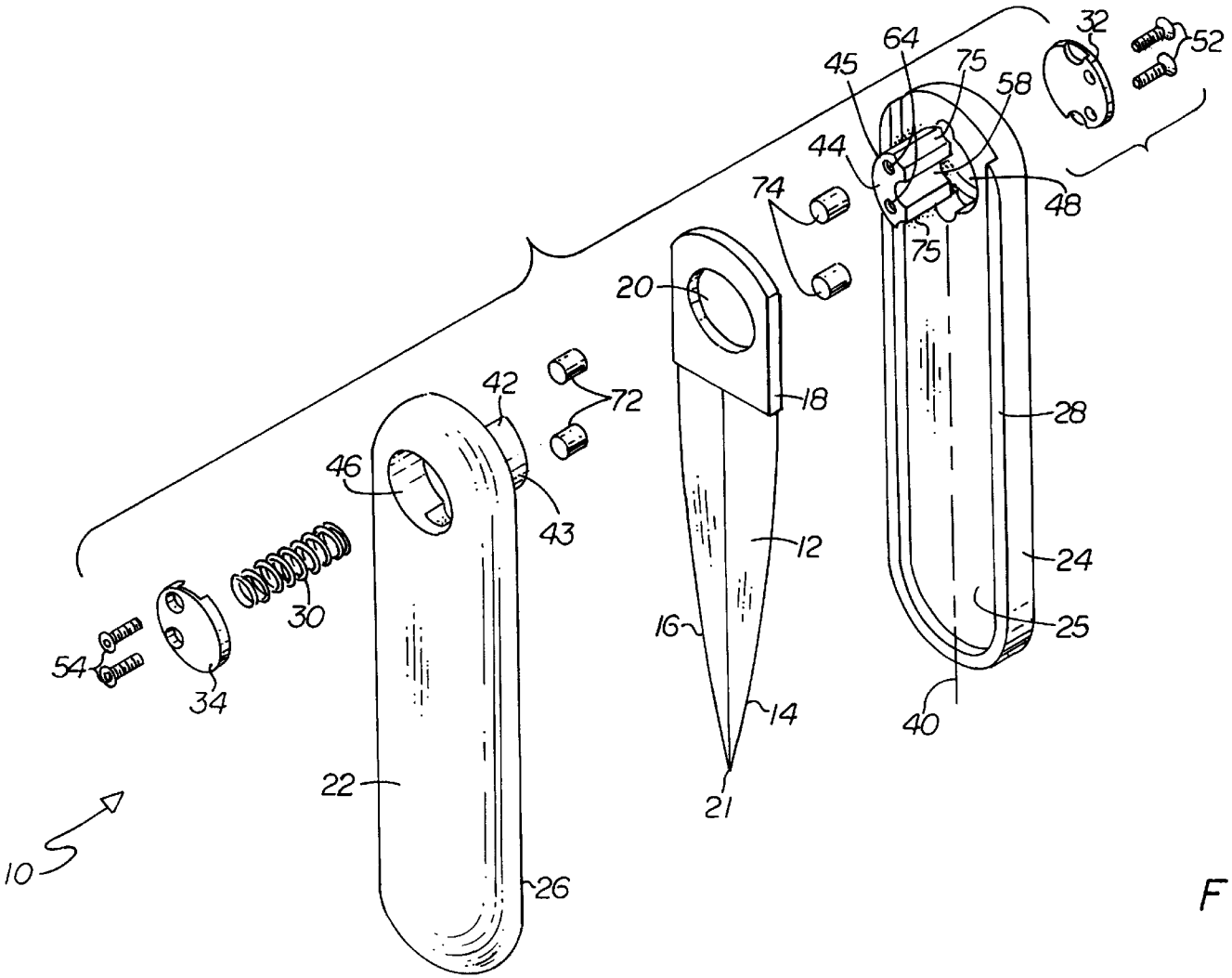
FIG. 1 is an exploded view of the novel elongate handle members of my knife, with the protrusions that are juxtaposed to form a support means for the knife blade being made apparent, with this view also making clear that I am advantageously able to use a compression spring for biasing the elongate handle members together.

With initial reference to FIG. 1 it will be seen that I have shown in exploded form, a novel knife 10 in accordance with this invention, involving a pivotally mounted blade 12 having sharpened edges 14 and 16. The base portion 18 of the blade is provided with an aperture 20 serving as the mounting means for the blade. The terminus 21 of the blade may be either pointed or rounded, and the blade may be constructed of any suitable material upon which sharpened edges can be maintained.

Operatively associated with the blade 12 is a first elongate handle member 22 and a second elongate handle member 24. The handle members 22 and 24 are intended to be fitted together so as to represent an effective containment means for the blade 12 when the blade is not in use; note FIG. 2*a*.

Figures 2A, 2B:
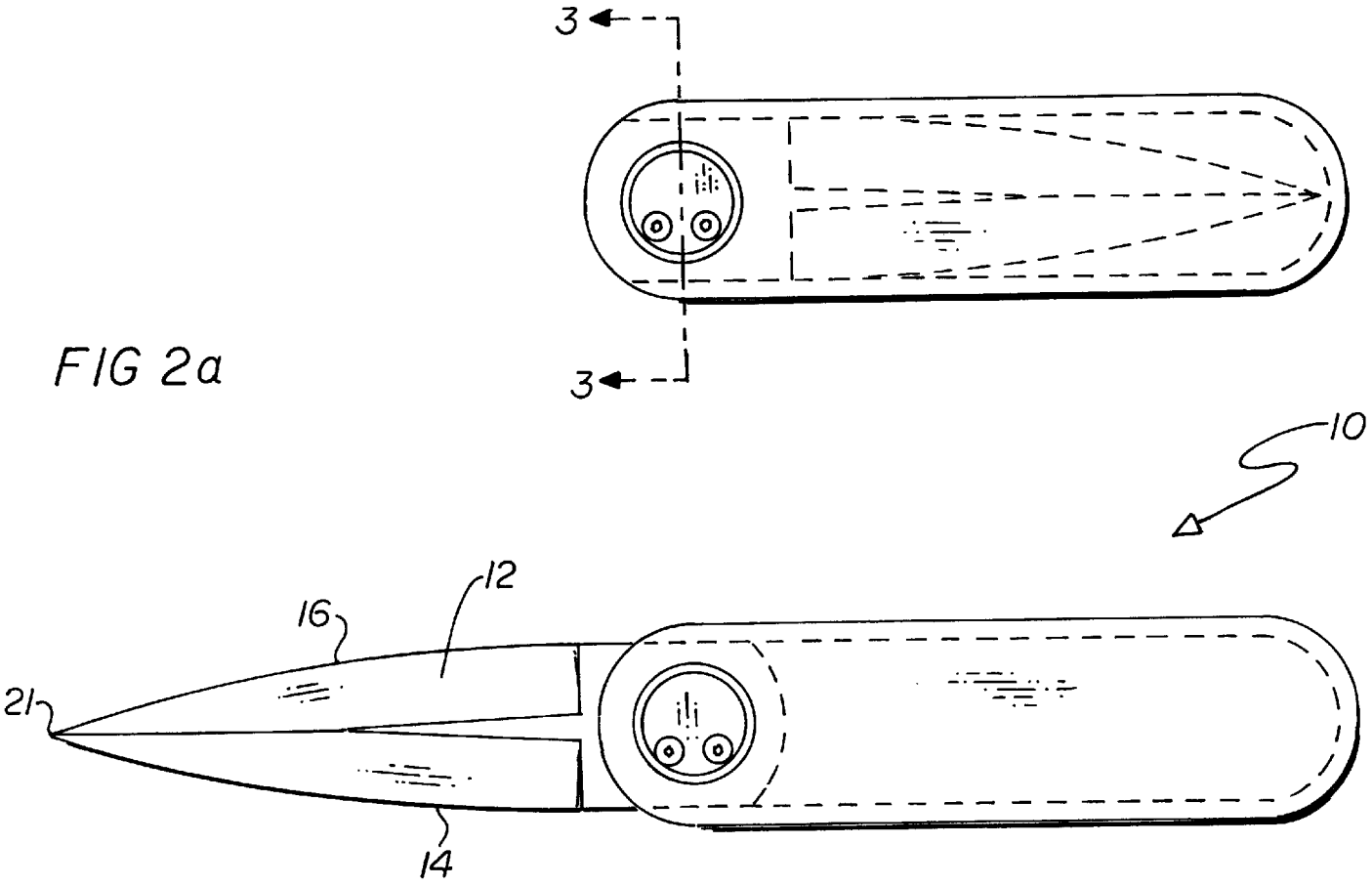
FIG. 2*a* is a view which depicts the position of the knife blade when in its folded position, as well as one of the two actuating disks that are to be pressed together when the knife blade is to be moved either to the folded or the extended position.
FIG. 2*b* is a view which depicts the position of the knife blade when in its extended position, with this view making clear that a multi-edged blade may be utilized in accordance with this invention.

As will shortly be explained in greater detail, the elongate handle members 22 and 24 can momentarily be moved apart for a limited extent so as to permit the blade 12 to be rotated into the extended position depicted in FIG. 2*b*. The assembled elongate handle members 22 and 24 form at that time a sturdy and highly effective grip, simplifying the manipulation and usage of the blade 12.

Certain significant aspects of the construction of my novel knife are to be noted in FIG. 1, with it there being revealed that the elongate handle member 24 has an essentially flat internal surface 25, with an upstanding protrusion 44 located adjacent one end thereof. Also to be noted is the fact that extending around a substantial portion of the perimeter or marginal edge of the elongate handle member 24 is a shoulder 28. More particularly, I prefer for the shoulder 28 to extend down both of the long edges of the handle member 24 and then curve around the end of the handle member opposite from the location of the protrusion 44.

It is to be understood that the elongate handle member 22 is closely similar to the handle member 24, with a shoulder 26 extending around a substantial portion of the perimeter or marginal edge of the elongate handle member 22. Although the shoulder 26 is not clearly visible in FIG. 1, it is to be understood that the shoulder 26 extends around the internal surface 23 (not shown in this figure) of the handle member 22 in an essentially identical manner as the shoulder 28 extends around the periphery of the internal surface 25 of the handle member 24.

Continuing with handle member 22, it is to be noted that projecting perpendicularly upward from the internal surface 23 of elongate handle member 22 is a protrusion 42. It is important to note that the protrusion 42 as well as the protrusion 44 forming an intrinsic part of the handle member 24 have surfaces permitting the protrusions to be placed in an abutting, relatively slidable relationship when the handle members have been placed in juxtaposition; note FIGS. 3*a* and 3*b*.

Both of the substantially identical protrusions 42 and 44 project for a relatively short distance perpendicularly from the internal surface of the respective handle member, and quite significantly, each of the protrusions is disposed on only one side of a longitudinal centerline 40 extending along the internal surface of each elongate handle member. The centerline 40 is visible on the internal surface 25 of the handle member 24 as viewed in FIG. 1. Also to be noted is the fact that the part of each of the protrusions remote from the longitudinal centerline has an essentially semi-circular surface. In FIG. 1 it will be seen that protrusion 42 of handle member 22 has an essentially semi-circular surface 43, and protrusion 44 of handle member 24 has an essentially semi-circular surface 45.

It is important to observe that an aperture is defined in each elongate handle member closely adjacent the respective protrusion, with aperture 46, clearly visible in FIG. 1, being located adjacent the upstanding protrusion 42 of handle member 22. Similarly, aperture 48 is defined in handle member 24 adjacent the upstanding protrusion 44. When viewed from the interior of the handle member, each of the apertures 46 and 48 is approximately the same size as the adjacent protrusion, but when each aperture is viewed from the exterior of the respective handle member, it is seen to be circular, for a purpose shortly to become apparent. Each aperture is located on the longitudinal centerline of the respective handle member.

The elongate handle members 22 and 24 are capable of being interfitted in a relatively movable manner and when interfitted, the pair of protrusions 42 and 44 form a highly satisfactory mounting means for the knife blade 12. It has already been mentioned that the surface of each protrusion remote from the centerline 40 is essentially semi-circular, with the result being that when the protrusions 42 and 44 have been caused to reside closely together, the essentially semi-circular surfaces 43 and 45 form a substantially circular component, which is of consequence from the standpoint of a desirable blade support. The protrusions 42 and 44 are of sufficient length that they continue to form an effective mounting means for the knife blade even when the protrusions have undertaken relative movement in a slidable manner as a consequence of the handle members moving apart for a limited extent.

Figure 3B:
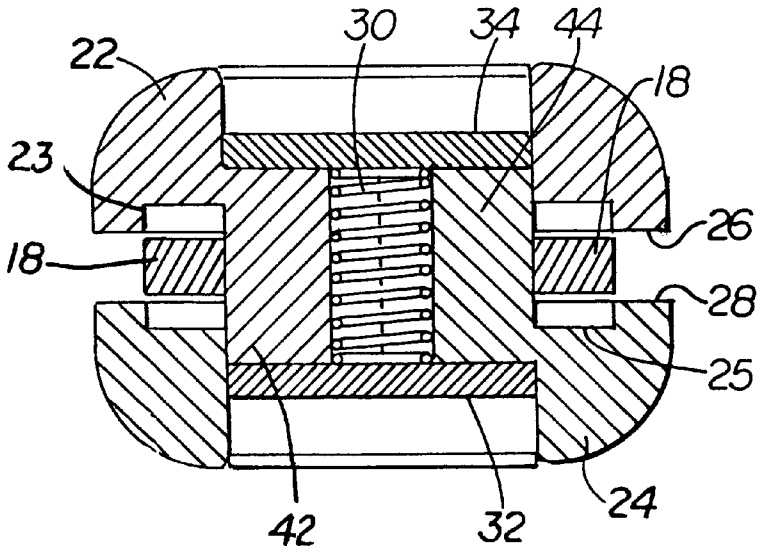
FIG. 3*b* is an end view closely related to FIG. 3*a*, but here showing how the shoulders are momentarily caused to move apart to permit rotation of the knife blade at such time as the user has caused the actuating disks to move simultaneously inward and to bring about further compression of the compression spring.
Figure 3A:
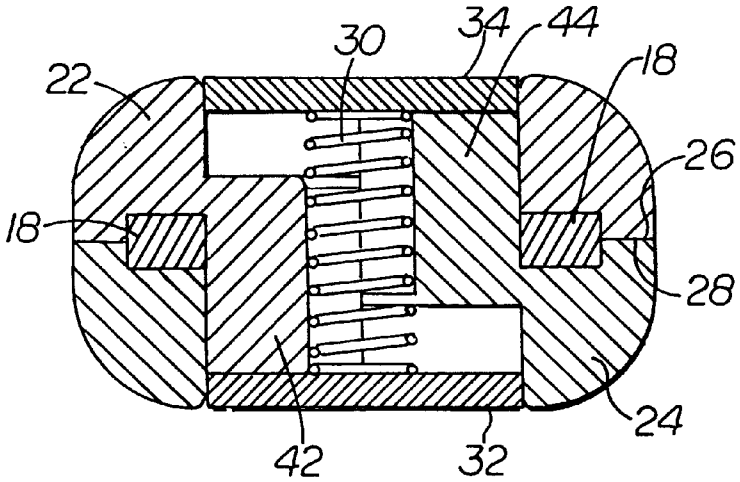
FIG. 3*a* is an end view of my novel knife, to a substantially larger scale, with this view revealing not only the placement of the compression spring, but also how the shoulder of one handle member is normally biased into contact with the shoulder of the adjacent handle.

With reference to FIGS. 3*a* and 3*b*, it will be noted that the base portion 18 of the knife blade adjacent the aperture 20 is revealed in cross section, and it will be apparent from these figures that portions of the base of the knife blade are depicted on each side of the protrusions 42 and 44. When the handle members have been caused to move away from the compacted relationship illustrated in FIG. 3*a* and into the somewhat separated positions depicted in FIG. 3*b*, it is readily possible for the knife blade 12 to be moved from the folded or retracted position into the extended position depicted in FIG. 2*b*.

With reference back to FIG. 1, it will be seen that I have illustrated actuating disks 32 and 34. The disk 32 is to be secured to the protrusion 42 of the elongate handle member 22, such as by a pair of small screws 52, at such time as the handle members have been interfitted and the protrusion 42 has been caused to reside in aperture 48 in the handle member 24. In a like manner, the actuating disk 34 is to be secured to the protrusion 44 of the elongate handle member 24 by a pair of small screws 54 when the handle members have been interfitted and the protrusion 44 has been caused to reside in aperture 46 in the handle member 22.

Each of the disks is of course equipped with a suitable pair of small holes to receive the aforementioned small screws, and each of the protrusions is provided with threaded holes that line up with the holes in the actuating disks. I provide tapped holes in protrusion 42 (not visible in FIG. 1) to receive the small screws 52, and I provide tapped holes 64 in protrusion 44 to receive the small screws 54, with the small screws 52 and 54 being tightly received in the respective threaded holes. Each of the operating disks is of a slightly smaller diameter than the aperture in which it is operatively disposed.

It is thus to be understood that after the handle members have been moved into the interfitting relationship, the actuating disk 32 is operatively disposed in the aperture 48 located in the second elongate handle member 24, and the actuating disk 34 is operatively disposed in the aperture 46 located in the elongate handle member 22.

A mid portion of the protrusion 44 is configured to define an elongate recess 58 and a like recess is defined in the protrusion 42 such that when the protrusions reside in a relatively movable juxtaposed relationship, the compression spring 30 can be accommodated between the protrusions. The spring 30 extends between the actuating disks 32 and 34 and resides in contact with the interior surface of each disk. Because, in a manner of speaking, each actuating disk is secured to the "opposite" handle member, the compression spring 30 serves to bias the handle members 22 and 24 together rather than apart.

It is thus to be seen that the actuating disks 32 and 34, when simultaneously depressed, cause a further compression of the spring 30 and the moving apart of the elongate handle members for a limited extent, in the manner depicted in FIG. 3*b*. At the time of the cooperative movement of the actuating disks in the inward direction it becomes readily possible for the blade to be moved in a pivotal manner around the substantially circular support means formed by the interfitted protrusions 42 and 44.

With reference back to FIG. 1, it will be noted that the base portion 18 of the blade 12 has straight sides, such that the blade 12 will be held tightly between the shoulders 26 and 28 when the handle members 22 and 24 are in contact with one another. Because of this, the blade of my novel knife is held very stably in the extended position. To be understood is the fact that only when the elongate handle members 22 and 24 have been caused to move apart to the limited extent to be noted from FIG. 3*b* will it be possible for the knife blade 12 to be rotated either to its extended position or back to its folded position.

It is thus to be understood that the spring means 30, visible in FIGS. 1, 3*a* and 3*b*, normally bias the elongate handle members into a closely fitted relationship, with the elongate handle members being moved apart by the user, against the bias of the spring 30, for a distance slightly exceeding blade thickness at such time as the user simultaneously presses upon the actuating disks 32 and 34.

It is to be noted from FIG. 1 that in addition to the previously mentioned components, I have depicted in this figure a pair of alignment pins 72, closely associated with protrusion 42, and a pair of alignment pins 74, closely associated with protrusion 44. Each of the alignment pins is of essentially cylindrical configuration, with suitable bores (not visible) being provided in the protrusion 42 and handle member 22 to receive the alignment pins 72, and bores 75 provided in protrusion 44 and handle member 24 to receive the alignment pins 74. It is the purpose of the alignment pins to contact the portion of the base portion 18 of the blade 12 in the vicinity of the aperture 20, thus to cause the blade to reside essentially equidistant from the handle members when the handle members have been moved apart into the relationship depicted in FIG. 3*b*.

It is thus to be understood that through contact with the respective actuating disk, each pair of alignment pins is driven through its respective bore into contact with the base portion of the blade. When the actuating disks 32 and 34 have been fully depressed in the manner depicted in FIG. 3*b*, the alignment pins positively locate the blade in a centered position between the elongate handle members, which permits the blade to freely rotate from the folded position into the extended position, or from the extended position back into the folded position.

Although in the preferred embodiment of my invention, I prefer the use of the two pairs of alignment pins for blade centering purposes, I am not to be restricted to this arrangement. In some instances it may be possible or desirable to use other blade centering means, such as a conically-tapered compression spring situated around the protrusions and located on each side of the base portion 18 of the blade 12.

From referring to FIGS. 3*a* and 3*b*, the operation of my knife should be quite apparent, with it to be noted that in FIG. 3*a* I have shown the coiled spring 30 serving to hold the actuating disks 32 and 34 apart. In this instance, it will be noted that protrusions 42 and 44 are disposed in what may be regarded as an offset relationship, brought about by the bias provided by the spring 30. It is also to be noted from each side of FIG. 3*a* that the shoulder 26 on the handle member 22 is in firm contact with the shoulder member 28 on the handle member 24. With regard to FIG. 3*a*, the appearance is the same whether the knife blade is in the extended or retracted position.

With reference now to FIG. 3*b*, it is there illustrated how the actuating disk 32, which is secured to protrusion 42, and the actuating disk 34, which is secured to protrusion 44, have been moved simultaneously in the inward direction, thus causing the spring 30 to become further compressed, and the protrusions to be moved from the offset relationship into what may be regarded as the aligned relationship depicted in FIG. 3*b*.

Of considerable consequence is the fact that in FIG. 3*b* I have shown the shoulders 26 and 28 having been momentarily moved apart so as to create a space sufficiently adequate that the knife blade 12 can be rotated in a pivotal manner about the protrusions 42 and 44, and into the extended relationship depicted in FIG. 2*b*.

At this point the user releases the actuating disks 32 and 34 which move, under the influence of the spring 30, back into the separated relationship depicted in FIG. 3*a*. At this time the shoulders 26 and 28 return to the touching relationship, with the blade being either held firmly in an extended position, or else encapsulated in a retracted position. It is to be noted that when the blade is in the retracted position, the shoulders moving into touching contact amounts to a relationship in which the blade is fully enclosed in a safe manner.

I claim:

1. A knife having a pivotally mounted blade, said knife comprising a pair of elongate handle members that, when fitted together, form a mounting means for pivotal movements of said blade, said blade being elongate and having at least one sharpened edge, with a terminus at one end and a circular aperture adjacent the other end, with said blade being movable between an extended position and a folded position, said handle members forming a means for grasping the knife when said blade is in its extended position as well as safely enclosing said blade when the knife is not in use and said blade has been moved to its folded position, each of said elongate handle members having an internal surface and an external surface, with a protrusion on said internal surface adjacent one end of each handle member, with each protrusion projecting for a relatively short distance perpendicularly from said internal surface of the respective handle member, each of said protrusions being disposed on only one side of a longitudinal centerline extending along said internal surface of each elongate handle member, with the part of each of said protrusions remote from said longitudinal centerline having an essentially semicircular surface, an aperture defined in each elongate handle member closely adjacent the respective protrusion, with a portion of such aperture in each handle member being disposed on the opposite side of said longitudinal centerline from the respective protrusion, said elongate handle members being capable of being interfitted in a relatively movable manner, said protrusions being caused, at the time said handle members have been interfitted, to be disposed closely together so as together to define a substantially circular component, said aperture of said blade being of a diameter such that it can be closely received upon said protrusions when said protrusions have been disposed closely together so as to form the substantially circular component, said elongate handle members being movable apart for a limited extent by the user, while causing a limited amount of sliding movement of one of said protrusions relative to the other, with such movement apart creating sufficient space between said handle members as will make possible, the pivotal movement of said blade into its folded or its extended position.

2. The knife having a pivotally mounted blade as recited in claim 1 in which said terminus is a point.

3. The knife having a pivotally mounted blade as recited in claim 1 in which spring means normally bias said elongate handle members into a closely fitted relationship, with said elongate handle members being moved apart, against the bias of said spring means, for a distance slightly exceeding blade thickness at such time as the user wishes to cause movement of said blade into its extended or its folded position.

4. The knife having a pivotally mounted blade as recited in claim 3 in which an actuating disk is operatively disposed in the circular portion of the aperture defined in each of said elongate handle members, with each actuating disk being attached to the protrusion of the opposite handle means, with said spring means being a compression spring extending between said actuating disks, said actuating disks, when simultaneously depressed, causing a further compression of said spring and the movement apart of said elongate handle members.

5. The knife having a pivotally mounted blade as recited in claim 3 in which centering means is utilized for causing said blade to reside essentially equidistant from each of said handle members when said handle members have been moved apart.

6. The knife having a pivotally mounted blade as recited in claim 5 in which said centering means involve a pair of alignment pins operatively disposed on each side of a base portion of said blade.

7. A knife having a pivotally mounted blade, said knife comprising a pair of elongate handle members that, when fitted together, form a mounting means for pivotal movements of said blade, said blade being elongate and having at least one sharpened edge, with a terminus at one end and a circular aperture adjacent the other end, with said blade being movable between an extended position and a folded position, said handle members forming a means for grasping the knife when said blade is in its extended position as well as safely enclosing said blade when the knife is not in use and said blade has been moved to its folded position, said handle members comprising first and second elongate handle members each having an internal surface as well as an external surface, with an upstanding protrusion on said internal surface of each handle member, adjacent one end of each handle member, said protrusion of each handle member being disposed on only one side of a longitudinal centerline extending along said internal surface of each elongate handle member, with the part of each protrusion remote from said longitudinal centerline having an essentially semicircular surface, an aperture defined in each of said elongate handle members, with a portion of each aperture being disposed on the opposite side of said longitudinal centerline from the respective protrusion and located closely adjacent such protrusion, the protrusions of said handle members being capable when said handle members have been moved into an interfitted relationship, of being disposed closely together to define a substantially circular component, said aperture of said blade being of a diameter such that it can be closely received upon said protrusions when said protrusions have been disposed closely together so as to form the substantially circular component, said handle members being movable apart for a limited extent by the user, while causing a limited amount of sliding movement of one of said protrusions relative to the other, with such movement causing the creation of sufficient space between said handle members as will make possible, the pivotal movement of said blade into its extended or its folded position.

8. The knife having a pivotally mounted blade as recited in claim 7 in which said terminus is a point.

9. The knife having a pivotally mounted blade as recited in claim 7 in which spring means normally bias said first and second handle members into a closely fitted relationship, with said elongate handles being moved apart, against the bias of said spring means, for a distance slightly exceeding blade thickness at such time as the user wishes to cause movement of said blade into its extended or its folded position.

10. The knife having a pivotally mounted blade as recited in claim 9 in which an actuating disk is operatively disposed in the circular portion of the aperture defined in each of said elongate handles, each actuating disk secured to the protrusion of the opposite one of said elongate handle members, with the actuating disk secured to said protrusion of said first elongate handle member being disposed in the aperture located in said second handle member, and the actuating disk secured to said protrusion of said second handle member being disposed in the aperture located in said first handle member, said spring means being a compression spring extending between said actuating disks, said actuating disks, when simultaneously depressed, causing a further compression of said spring and the moving apart of said elongate handle members.

11. The knife having a pivotally mounted blade as recited in claim 9 in which centering means is utilized for causing said blade to reside essentially equidistant from each of said handle members when said handle members have been moved apart.

12. The knife having a pivotally mounted blade as recited in claim 11 in which said centering means involve a pair of alignment pins operatively disposed on each side of a base portion of said blade, said pins undertaking a limited amount of sliding movement at the time said actuating disks are depressed.

13. The knife having a pivotally mounted blade as recited in claim 7 in which a relatively narrow shoulder is disposed on the internal surface of each of said elongate handle members, with said shoulder extending along both of the long sides of each of said handle members, as well as around the end remote from the protrusion of each of said handle members.

14. The knife having a pivotally mounted blade as recited in claim 13 in which said shoulder on each long side of each of said handle members serves to hold said blade firmly in a fixed position when said blade has been moved into its extended position.

* * * * *